US008190338B2

(12) United States Patent
Commuri

(10) Patent No.: US 8,190,338 B2
(45) Date of Patent: May 29, 2012

(54) METHOD AND APPARATUS FOR COMPACTION OF ROADWAY MATERIALS

(75) Inventor: Sesh Commuri, Norman, OK (US)

(73) Assignee: The Board of Regents of the University of Oklahoma, Norman, OK (US)

( * ) Notice: Subject to any disclaimer, the term of this patent is extended or adjusted under 35 U.S.C. 154(b) by 454 days.

(21) Appl. No.: 12/583,838

(22) Filed: Aug. 26, 2009

(65) Prior Publication Data

US 2010/0172696 A1 Jul. 8, 2010
US 2011/0293369 A9 Dec. 1, 2011

Related U.S. Application Data

(60) Provisional application No. 61/190,715, filed on Sep. 2, 2008.

(51) Int. Cl.
*G06F 7/70* (2006.01)
*G01N 29/00* (2006.01)
*G01N 9/00* (2006.01)

(52) U.S. Cl. ..... 701/50; 73/1.82; 73/32 A

(58) Field of Classification Search ..... 701/50; 702/87, 88, 103, 137; 700/275; 73/1.82, 73/1.88, 32 A, 12.12, 573, 594, 579; 404/75, 404/102, 103, 84.1, 117
See application file for complete search history.

(56) References Cited

U.S. PATENT DOCUMENTS 3,998,090 A 12/1976 Wislocki
4,103,554 A 8/1978 Thurner
5,402,667 A 4/1995 Atkinson et al.
5,493,494 A * 2/1996 Henderson ..... 701/50
5,727,900 A 3/1998 Sandstrom
6,122,601 A 9/2000 Swanson et al.
6,431,790 B1 8/2002 Anderegg et al.
6,551,019 B1 4/2003 Motz
6,577,141 B2 6/2003 Gandrud
6,604,432 B1 8/2003 Hamblen et al.
6,742,960 B2 * 6/2004 Corcoran et al. ..... 404/117
6,752,567 B2 * 6/2004 Miyamoto et al. ..... 404/84.1
6,786,077 B2 9/2004 Baumoel et al.
6,829,986 B2 12/2004 Richter
6,912,903 B2 7/2005 Hamblen et al.
6,925,879 B2 * 8/2005 Raichle ..... 73/579
6,941,793 B2 9/2005 Rioux
7,191,062 B2 * 3/2007 Chi et al. ..... 702/2
7,216,543 B2 5/2007 Paik et al.

(Continued)

OTHER PUBLICATIONS

Geodynamik Catalog ALFA-030, "Compactometer, compaction meter for vibratory rollers," entire catalog, undated but admitted to be prior art.

(Continued)

*Primary Examiner* — Thomas Will
*Assistant Examiner* — Abigail A Risic
(74) *Attorney, Agent, or Firm* — McAfee & Taft

(57) ABSTRACT

A method of compacting a roadway section includes entering initial input parameters into a compaction analyzer. A plurality of passes is made with a roller over a portion of the roadway section and vibratory energy is applied thereto. Responsive vibration signals are gathered and the compaction analyzer generates estimated density signals. Actual density measurements are taken and the estimated densities are compared thereto. Selected ones of the initial input parameters are adjusted so that an adjusted density output signal which represents the actual density of a roadway section is generated.

48 Claims, 5 Drawing Sheets
(2 of 5 Drawing Sheet(s) Filed in Color)

U.S. PATENT DOCUMENTS

| | | | | |
|---|---|---|---|---|
| 7,430,914 | B2 * | 10/2008 | Mitchell et al. | 73/649 |
| 7,669,458 | B2 * | 3/2010 | Commuri et al. | 73/32 A |
| 7,966,882 | B2 * | 6/2011 | Greenwood | 73/597 |
| 2001/0037671 | A1 | 11/2001 | Bilmes et al. | |
| 2002/0129653 | A1 | 9/2002 | Seth et al. | |
| 2002/0175691 | A1 * | 11/2002 | Sovik et al. | 324/654 |
| 2004/0035207 | A1 | 2/2004 | Hamblen et al. | |
| 2006/0096354 | A1 | 5/2006 | Commuri et al. | |
| 2007/0276602 | A1 * | 11/2007 | Anderegg et al. | 702/2 |
| 2008/0003057 | A1 * | 1/2008 | Hall et al. | 404/84.1 |
| 2009/0214300 | A1 * | 8/2009 | Birgisson et al. | 405/271 |
| 2010/0087992 | A1 * | 4/2010 | Glee | 701/50 |

OTHER PUBLICATIONS

Jean-Louis Briaud and Jeongbok Seo, "Intelligent Compaction: Overview and Research Needs," Report, Dec. 2003, Texas A&M University, entire document.

Edward J. Jaselskis, Hsiu Han, Lawrence Tan and Jonas Grigas, "Roller Mountable Asphalt Pavement Quality Indicator," 1998 Transportation Conference Proceedings, 1998, pp. 192-194.

Edward J. Jaselskis, Hsiu C. Han, Jonas Grigas, Lawrence Tan and Daniel Fahrion, "Status of Roller Mountable Microwave Asphalt Pavement Density Sensor," Journal of Construction Engineering and Management, pp. 46-52, Jan./Feb. 2001.

R. Edward Minchin, Jr. and H. Randolph Thomas, "Validation of Vibration-Based Onboard Asphalt Density Measuring System," Journal of Construction Engineering and Management, pp. 1-7, Jan./Feb. 2003.

Timothy R. Clyne, Xinjun Li, Mihai O. Marasteanu and Eugene L. Skok, "Dynamic and Resilient Modulus of Mn/DOT Asphalt Mixtures," Final Research Report, Feb. 2003, entire document, Minnesota Department of Transportation, Research Services, St. Paul, Minnesota.

Michael A. Mooney, Essam F. Tawfik, Godfrey B. Chan and Jie L. Pan, "Health monitoring during vibratory compaction of soil," Report, Apr. 8, 2003, entire document, School of Civil Engineering and Environmental Science and School of Electrical and Computer Engineering, The University of Oklahoma.

Ake J. Sandstrom and Carl B. Petterson, "Intelligent Systems for QA/QC in soil compaction," Report, Nov. 14, 2003, entire document, Geodynamik HT AB, Stockholm, Sweden.

Heinz F. Thurner and Ake Sandstrom, "Continuous Compaction Control, CCC," European Workshop Compaction of Soils and Granular Materials, Paris, May 19, 2000, pp. 237-246, Geodynamik AB, Stockholm, Sweden.

Tai-Sung Yoo and Ernest T. Selig, "Dynamics of Vibratory-Roller Compaction, Journal of the Geotechnical Engineering Division," Oct. 1979, pp. 1211-1231 and 1291-1295, vol. 105, No. GT10.

* cited by examiner

METHOD AND APPARATUS FOR COMPACTION OF ROADWAY MATERIALS

CROSS REFERENCE TO RELATED APPLICATION

This application incorporates by reference and claims the benefit of U.S. Provisional Application 61/190,715 filed on Sep. 2, 2008.

BACKGROUND OF THE INVENTION

The current disclosure is directed to methods and apparatus for the compaction of roadway materials, and more particularly, to methods and apparatus for calibrating a compaction analyzer.

Asphalt is often used as pavement. In the asphalt paving process, various grades of aggregate are used. The aggregate is mixed with asphalt cement (tar), and a paver lays down the asphalt mix and levels the asphalt mix with a series of augers and scrapers. The material as laid is not dense enough due to air voids in the asphalt mix. Therefore, a roller makes a number of passes over the layer of asphalt material, referred to herein as the asphalt mat, driving back and forth, or otherwise creating sufficient compaction to form asphalt of the strength needed for the road surface.

One of the key process parameters that is monitored during the compaction process is the compacted density of the asphalt mat. While there are many specifications and procedures to ensure that the desired density is achieved, most of these specifications require only 3-5 density readings per lane mile. Typically, the density readings will be from extracted roadway cores. The process of measuring density of the asphalt mat during the compaction process is cumbersome, time-consuming, and is not indicative of the overall compaction achieved unless measurements are taken at a large number of points distributed in a grid fashion, which is difficult to achieve in the field due to cost considerations alone. Failure to meet the target density is unacceptable and remedial measures may result in significant cost overruns. Thus, there is a need to develop an intelligent monitoring system that will predict the compacted mat density in real time, over the entire pavement surface being constructed. Because the density cannot be measured directly, researchers have attempted different methods for indirect measurements.

A method that has found some success involves the study of the dynamical characteristics of the vibratory compactors typically used in the field. The compactor and the asphalt mat can be viewed as a mechanically coupled system. An analytical model representing such a system can be used to predict the amount of compaction energy transferred to the mat as a function of frequency (coupled system). The amount of energy transferred can be viewed as a measure of the effectiveness of compaction. The machine parameters, like frequency and speed, can then be altered to maximize the energy transferred, thereby increasing the compaction. However, this method does not yield the compacted density directly; also, relating the energy dissipation to the compacted density is problematic. Therefore, this approach is not suitable to determine the level of compaction of an asphalt roadway.

A number of researchers also tried to study the performance of the compactor during soil and asphalt compaction by observing the vibratory response of the compactor. The vibration energy imparted to the ground (sub-grade soil) during compaction also results in a vibratory response of the compactor. The amplitude and frequency of these vibrations are a function of the compactor parameters and the sub-grade.

Thus, the observed vibrations of the compactor can be used to predict the properties of the material being compacted. U.S. Pat. No. 5,727,900 issued to Sandstrom discloses using the frequency and amplitude of vibration of the roller as it passes over the ground to compute the shear modulus and a "plastic" parameter of sub-grade soil. These values are then used to adjust the velocity of the compactor and its frequency and amplitude. Thus, this method attempts to control the frequency of the vibratory motors and the forward speed of the compactor for optimal compaction rather than estimate the density of the compacted soil.

Other methods involve estimating the degree of compaction by comparing the amplitude of the fundamental frequency of vibration of the compactor with the amplitudes of its harmonics. The compactor is instrumented with accelerometers to measure the vibrations of the compactor during operation. By relating the ratio of the second harmonic of the vibratory signal to the amplitude of the third harmonic, the compacted density is estimated with, in some cases, 80% accuracy. These results are encouraging and validate the correlation between the observed vibrations and the property of the material being compacted. However, the accuracy of these techniques needs improvement, as the properties of the asphalt pavement are significantly different at 96.5% and 98% target densities. Further, these methods are susceptible to variations in the data gathered.

Attempts have been made to account for some of the variations seen in the vibratory response of compactors by considering the properties of the mix and the site characteristics, in addition to the vibratory response of the compactor, to estimate density. In one approach a microwave signal is transmitted through the asphalt layer, and the density is estimated based on the transmission characteristics of the wave. While the above techniques have been successful in demonstrating the feasibility of the respective approaches, they need to be further refined before they can be used to predict the density in the field with the required degree of precision.

U.S. patent application Ser. No. 11/271,575 (the '575 application), assigned to the assignee of the present disclosure also provides a method and apparatus for density prediction. In that application, a compactor is utilized to compact a test section, and a vibratory energy is applied to the test section as the compactor moves. Responsive vibratory signals of the compactor are gathered, and the density of the test section is measured with means known in the art, for example, nuclear density gauges, or by cutting cores from the test section and measuring the density of the cores. The vibratory response signals of the compactor are correlated with the measured densities, so that a compaction analyzer can be programmed to generate a signal representative of the measured density when the corresponding vibratory response signal occurs.

The compactor is then utilized to compact an actual roadway section built using roadway material with the same characteristics, and the compaction analyzer will generate density signals based upon the responsive vibratory signals of the compactor. The analyzer will compare the vibratory signals of the compactor to those generated on the test section, and will generate density signals based upon the comparison. In other words, when the analyzer recognizes a vibration signal as the same or similar to that generated on the test section, it will generate a density reading based upon the measurements taken on the test section. While the method and apparatus of the '575 application work well, the construction of an asphalt test mat separate from the roadway being constructed is required, which can be time-consuming and costly.

SUMMARY OF THE INVENTION

The apparatus disclosed herein comprises a vibratory compactor, or roller, with sensors, and a compaction analyzer associated therewith. The compaction analyzer has a feature extraction module, a neural network module and an analyzer module. The sensors may comprise accelerometers for measuring vibratory response signals of the roller, and the compaction analyzer utilizes the characteristics of the vibratory response signals to generate, in real time, a density signal representative of the density of the material being compacted. A method of compacting a roadway section with a roller having a compaction analyzer operably associated therewith comprises entering initial input parameters into the compaction analyzer and making a plurality of passes with the roller over a portion of the roadway section. The method may further comprise applying a vibratory energy to the portion of the roadway section with the roller as it moves over the portion of the roadway section and repeatedly gathering responsive vibration signals of the roller as it moves over the portion of the roadway section. Additional steps may comprise generating, with the compaction analyzer, estimated density signals representative of estimated densities based upon the responsive vibration signals of the roller and the initial input parameters entered into the compaction analyzer and measuring the density of the roadway section at a plurality of locations on the portion of the roadway section. The measured densities may be compared to the estimated densities at the plurality of locations to determine the difference between the measured and the estimated densities. Selected ones of the initial input parameters to the analyzer can then be adjusted based on the difference between the measured densities and the estimated densities. The compaction analyzer will generate an adjusted density output signal which will more closely approximate an actual density of the roadway section than does the estimated density signal. The remainder of the roadway section is rolled until the compaction analyzer with the adjusted input parameters generates a desired adjusted output density signal.

Another method may comprise entering initial input parameters into the compaction analyzer and making a plurality of passes over a portion of the roadway section. Vibratory energy may be applied to a portion of the roadway section as the plurality of passes are made, responsive vibratory signals of the roller generated in response to the applied vibratory energy are gathered. Selected responsive vibratory signals may be designated as corresponding to specified compaction levels, and the compaction levels of the portion of the roadway section representative of the responsive vibratory signals delivered in real time to an analyzer module in the compaction analyzer as the roller moves along the portion of the roadway section. An estimated density is generated in real time with the compaction analyzer based on the delivered compaction level and the initial input parameters as the roller rolls along the portion of the roadway. Actual density measurements of the portion of the roadway section may be taken at a plurality of locations on the portion of the roadway section to determine measured densities at the plurality of locations. The estimated densities generated by the compaction analyzer at the plurality of locations are compared with the actual measured densities at the plurality of locations, and selected ones of the initial input parameters are adjusted based upon the differences between the estimated densities and the measured densities. An adjusted density of the roadway section is generated in real time based upon the delivered compaction levels and the adjusted input parameters that more closely approximate the actual density than did the estimated density.

BRIEF DESCRIPTION OF THE DRAWINGS

The patent or application file contains at least one one drawing executed in color. Copies of this patent or patent application publication with color drawing(s) will be provided by the Office upon request and payment of the necessary fee.

DESCRIPTION OF A PREFERRED EMBODIMENT

The current disclosure is directed to methods and apparatus for compacting a roadway, and for using, and calibrating an Intelligent Asphalt Compaction Analyzer (IACA).

Figure 1:
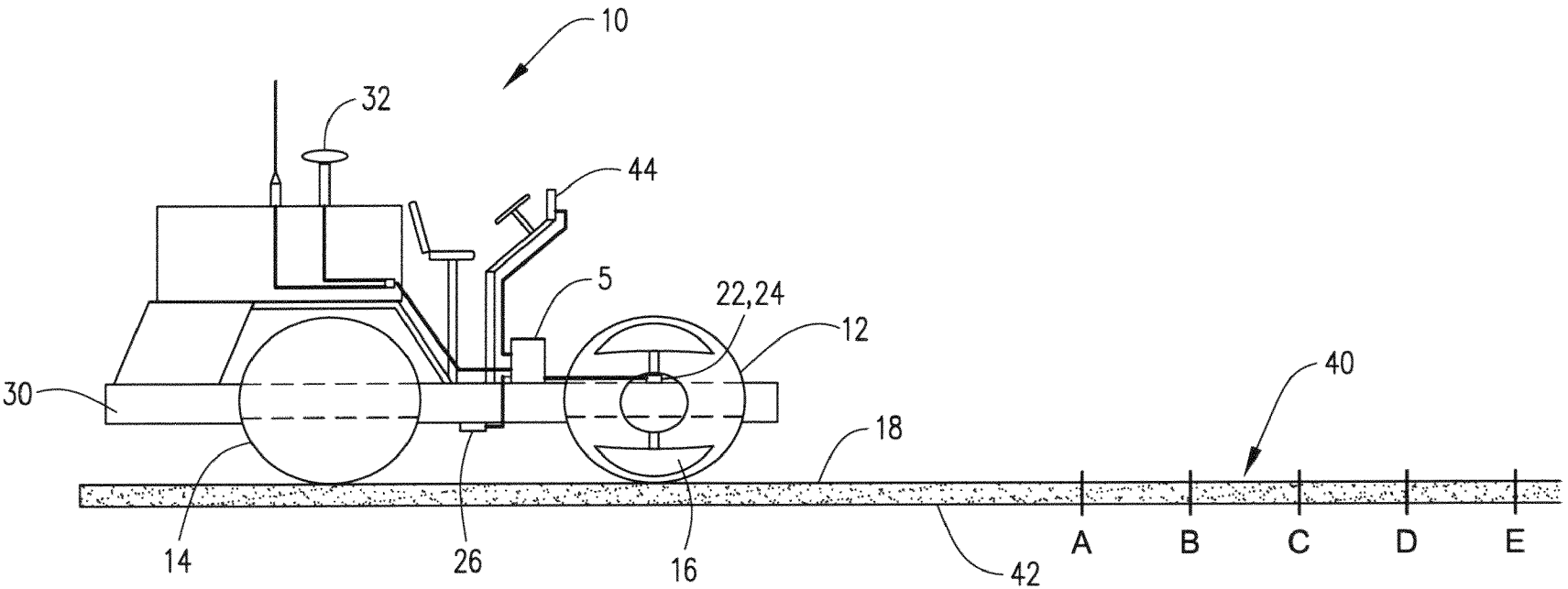
FIG. 1 is a schematic representation of a roller with a compaction analyzer.
Figure 2:
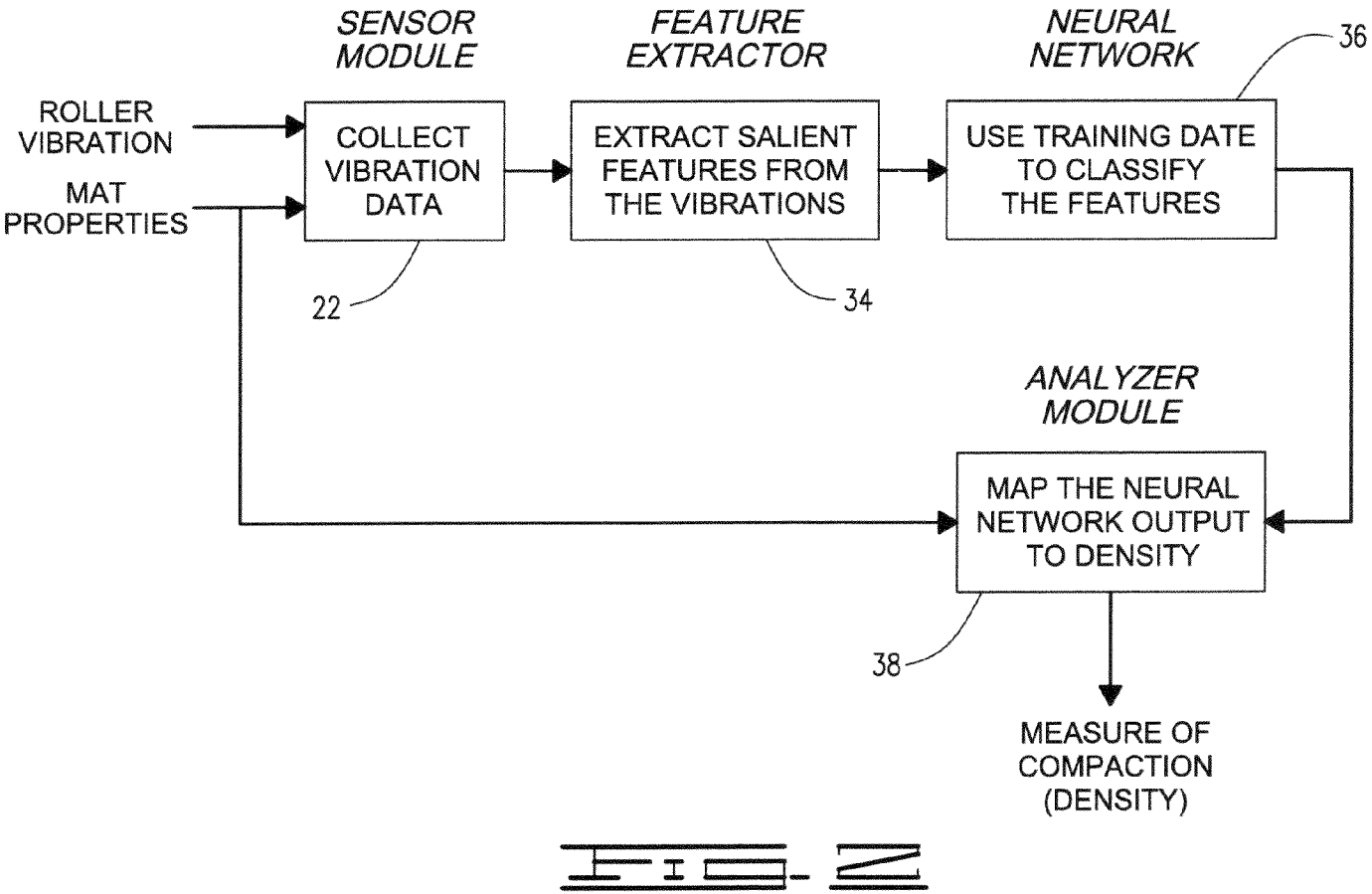
FIG. 2 is a schematic representation of the compaction analyzer components.

FIG. 1 schematically shows the IACA 5, a device that can measure the density of an asphalt pavement continuously in real time, over the entire length of the pavement during its construction. Quality control techniques currently used in the field involve the measurement of density at several locations on the completed pavement or the extraction of roadway cores. These methods are usually time-consuming and do not reveal the overall quality of the construction. Furthermore, any compaction issues that are identified cannot be easily remedied after the asphalt mat has cooled down.

In recent years, several Intelligent Compaction (IC) technologies have been introduced by manufacturers of vibratory compactors. Uniform compaction of both soil and aggregate bases is achieved through the variation of the machine parameters (amplitude and frequency of vibrations, vectoring of the thrust, etc.). Dynamic control of the machine parameters allows for the application of the vibratory energy only to under-compacted areas and thereby preventing over-compaction and ensuring uniform compaction of the soil/aggregate base. While these IC techniques hold promise for the future, their performance is yet to be fully evaluated. Further, these IC products require the purchase of a new vibratory compactor that is equipped with the technology.

In contrast to the IC technologies being offered in the market place today, IACA 5 is a measurement device that does not control any aspect of the machine behavior. Further, IACA 5 is a stand-alone device that can be retrofitted on any existing vibratory compactor. A primary utility of IACA 5 is in providing real-time measurements of the density of the asphalt mat at each location on the pavement under construction. This information can be utilized by the roller operator to ensure uniform compaction, address under-compaction, as well as prevent over-compaction of the pavement.

IACA 5, as shown in FIG. 1, functions on the hypothesis that the vibratory roller, for example vibratory roller 10, and the underlying pavement material, which may be, for example, Hot Mix Asphalt (HMA) form a coupled system. The response of vibratory roller 10 is determined by the frequency of its vibratory motors and the natural vibratory modes of the coupled system. Compaction of an asphalt mat increases its stiffness and as a consequence, the vibrations of the compactor are altered. The knowledge of the properties of the pavement material and the vibration spectrum of the compactor can therefore be used to estimate the stiffness of the asphalt mat. Quality specifications for HMA are generally specified as a percentage of air voids so that, for example, 100% density means no air voids exist, and 90% density means 10% air voids exist. Since the quality specifications are usually specified as percentage air void content or as a percentage of the Maximum Theoretical Density (MTD) of the asphalt mat, IACA 5 estimates the compacted density of the pavement rather than the stiffness.

Referring now to the drawings, vibratory compactor, or roller 10 is shown in FIG. 1. Vibratory compactor 10 which may be, for example, a DD-138 HFA Ingersoll Rand vibratory compactor, includes forward and rear drums 12 and 14, Forward drum 12 has an eccentric weight 16 mounted therein, and if desired, both forward and rear drums 12 and 14 may have eccentric weights 16 mounted therein. Eccentric weights 16 are rotated by motors (not shown), so that the rotation of the weights 16 within drums 12 and 14 cause an impact at the contact between drums 12 and 14 and a base 18, which may be comprised of HMA. Base 18 may be referred to as asphalt mat 18. The spacing between impacts is a function of the speed of the roller 10, and the speed of the eccentric weights 16, and may be, for example, 10-12 impulses per linear foot. Sensor module 22 associated with IACA 5 consists of accelerometers 24 mounted to frame 30 for measuring the vibrations of the compactor 10 during operation and may include infrared temperature sensors 26 for measuring the surface temperature of the asphalt base. Accelerometer 24 and temperature sensors 26 may be mounted to a frame 30 of roller 10. Sensors 26 essentially comprise a real-time data acquisition system. IACA 5 may include a user interface 28 which may be an Intel Pentium based laptop for specifying the amplitude and frequency of the vibration motors, and to input mat properties such as the mix type and lift thickness. User interface 28 will also be utilized to enter other initial input parameters as will be explained in more detail hereinbelow. Accelerometer 24 may be a CXL10HF3 tri-axial accelerometer manufactured by Crossbow, capable of measuring 10 g acceleration up to a frequency of 10 kHz. The surface temperature of asphalt mat 18 may be measured using an infrared temperature sensor 26 mounted on the frame 30. A global positioning system (GPS) 32 may also be mounted to roller 10. The GPS will, as is known in the art provide locations of roller 10 and will be coordinated with IACA 5 so that the location of the densities generated by IACA 5 will be known. GPS receiver 32 may be, for example, a Trimble Pro XT GPS receiver used to record the location of the roller 10 as it moves.

IACA 5 includes a feature extraction (FE) module 34 which computes the Fast Fourier Transform (FFT) of the input signal and extracts features corresponding to vibrations at different salient frequencies. The input signals are the responsive vibratory signals of roller 10, which results from the impacts made by the eccentric weights 16. The responsive vibratory signals are measured, or gathered by accelerometer 24. IACA 5 also includes a Neural Network (NN) Classifier 36 which is a multi-layer Neural Network that is trained to classify the extracted features into different classes, where each class represents a vibration pattern specific to a pre-specified level of compaction. Compaction analyzer module 38 in IACA 5 post-processes the output of the neural network and estimates the degree of compaction in real time. Each component of IACA 5 will be described in more detail hereinbelow.

Figure 3:
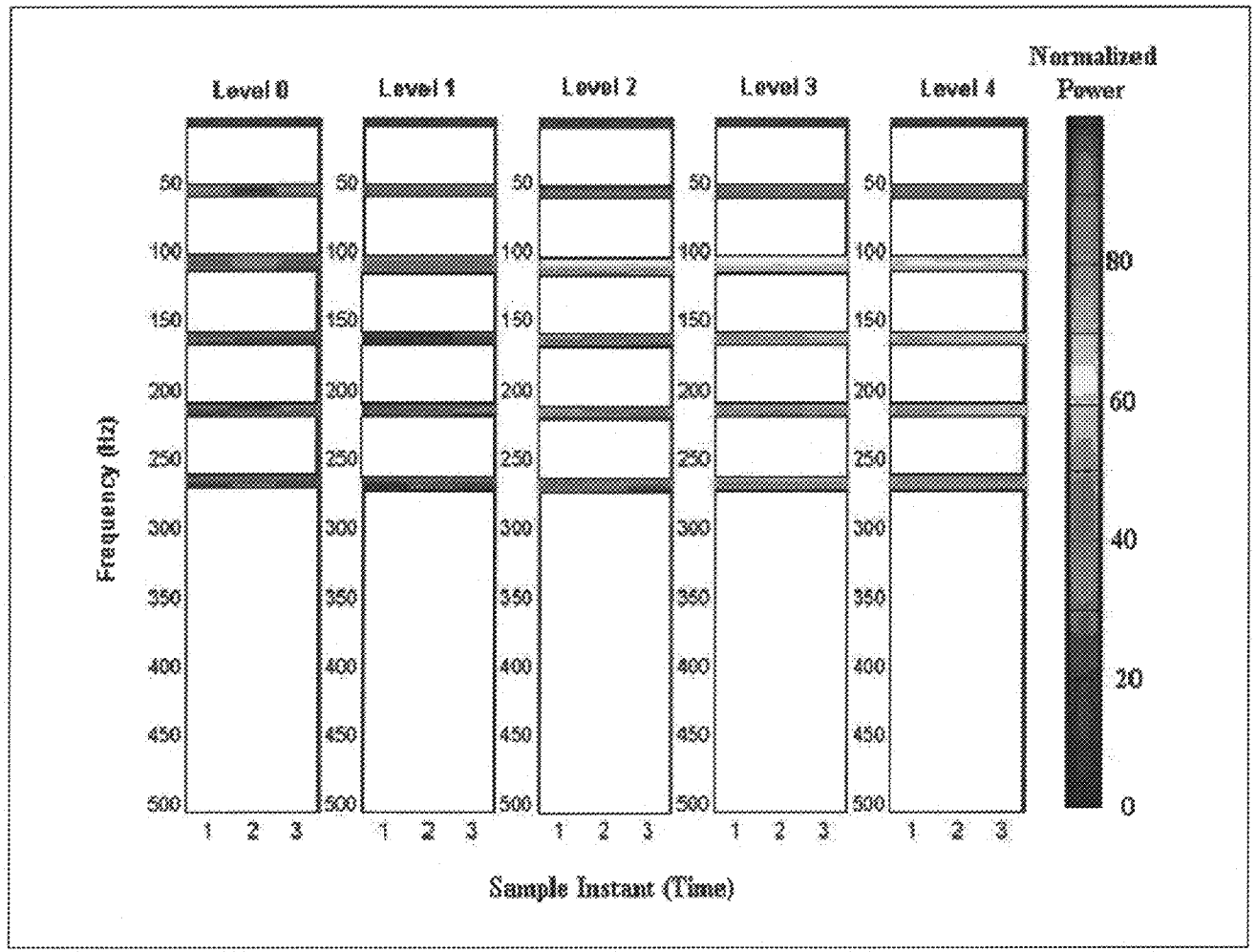
FIG. 3 is exemplary and shows spectral features at an instant in time.

Feature extractor module 34 implements a Fast Fourier Transform to efficiently extract the different frequency components of the responsive vibratory signals of roller 10. The output of the FFT is a vector with 256 elements, where each element corresponds to the normalized signal power at the corresponding frequency. The normalized signal power, as is understood, is the square of the amplitude at the frequency, so the extracted features are frequencies, and amplitudes at the frequencies. FIG. 3 is an example of the spectral features of vibratory signals, and shows frequencies, and the normalized power (i.e., squares of amplitudes) of the frequencies. The vibration signal of the roller 10 is sampled at a rate of 1 kHz (1000 Hz/sec). Because the responsive vibration signal of the roller 10 is sampled at 1 kHz, it is understood that the frequency spectrum is uniformly distributed from 0 to 500 Hz. Since the FFT output is a sector with 256 elements, the features are extracted in frequency bands of approximately 2 Hz. Features may be extracted eight times per second in an overlapping fashion, such that the input to the neural network 36 will include 128 elements from the previous instant at which features were extracted, and 128 elements from the current or immediate feature extraction.

Neural network classifier 36 is a three layer neural network with 200 inputs, 10 nodes in the input layer, 4 nodes in the hidden layer, and 1 node in the output layer. The inputs of the neural network correspond to the outputs of the feature extraction module, i.e., in this case 200 features in the frequency spectrum. In the preferred embodiment, only the upper 200 features in the frequency spectrum (i.e., from 100-500 Hz) are considered. Those in the lower range represent the frequency of roller 10 and may be ignored. Neural network 36 will classify the vibratory response signals of roller 10 into classes representing different levels of compaction.

The output of feature extraction module 34 is analyzed over several roller passes during the calibration process and the total power content in the responsive vibration signal of roller 10 is calculated at each instant in time. The power calculation is set forth hereinbelow. A minimum power level, a maximum power level, and equally spaced power levels are identified and the features of the vibratory response signal that correspond to the identified power levels are used to train the neural network 36. The identified minimum, maximum and equally spaced power levels are designated as corresponding to specified levels of compaction. During the compaction process, the neural network 36 observes the features of the responsive vibration signals of the roller and classifies the features as corresponding to one of the levels of compaction.

The plurality of pre-specified compaction levels will be identified, or designated with a number. In the case where five compaction levels are specified, a minimum compaction level can be identified, or designated as compaction level 0, and a maximum compaction level can be designated as compaction level 4. The compaction levels therebetween can be designated as compaction levels 1, 2 and 3 which correspond to the equally spaced power levels between the minimum and maximum power levels. FIG. 3 is exemplary, and shows features corresponding to five different compaction levels, with the lowest level corresponding to the case where the roller is operating with the vibration motors turned on and designated as level 0, level 4 designated as corresponding to the case where the maximum vibration is observed, and levels 1 through 3 corresponding to spaced levels therebetween.

The initial calibration of IACA 5 assumes that compaction level 0 corresponds to a lay-down density of the asphalt mat and the compaction level 4 corresponds to the target density as specified in the mix design sheet (designed at 100 gyrations of the superpave gyratory compactor). The lay-down density of asphalt is generally assumed to be, for example, 85% to 88%, and the target or maximum density will generally be 94-97%. Compaction levels 1, 2 and 3 are designated as corresponding to equally spaced densities therebetween.

During the calibration operation, roller 10 will make several passes on asphalt mat 18. Asphalt mat 18 may include a portion 40 of a roadway section 42 to be compacted. The portion 40 will comprise a defined length, for example, thirty feet. Locations will be identified on the portion of the roadway, marked as locations A, B, C, D and E on FIG. 1. The locations will be used to obtain actual measured densities of the portion 40 of the roadway section 42. It is understood that roadway section 42 may extend for several miles and that once the calibration described herein has occurred, rolling of the remainder of the roadway section 42 can occur without further actual measurement of the density so long as the roadway section is comprised of the same roadway material as portion 42, based upon the output of the IACA 5 as indicated on an IACA display 44.

As roller 10 makes a plurality of passes over the portion 40 of roadway section 42, eccentric weights 16 will generate impacts as described herein. Responsive vibratory signals of roller 10 are gathered by accelerometer 24 as roller 10 moves along portion 40 by accelerometer 24.

Roller 10 will cease making passes when the responsive vibratory signals become consistent, which indicates that no further change in compaction is occurring. Roller 10 should stop, for example, before rollover occurs.

The power content of the responsive vibratory signals of roller 10 are calculated using the extracted features by feature extractor 34. The power content is calculated each time a feature extraction occurs, which as described herein, may be eight times per second.

The power level, or power content of the responsive vibratory signals of roller 10 can be calculated as follows. Using i as the index in the frequency domain, such that $i=1, \ldots, n_i$, and 'j' as the index in the time domain such that $j=1, \ldots, n_j$, $n_i$ represents the maximum number of features extracted from the vibration signal and $n_j$ represents the maximum number of samples of the vibration signal. The spectrogram of the vibration signal can be represented by a matrix of $n_i$ rows and $n_j$ columns, where each element of the spectrogram 's' represents the normalized power in a given feature at a particular instant in time (i.e., the square of the amplitude of the frequency). For example, the element in the $i^{th}$ row and $j^{th}$ column represents the normalized power contained in the $i^{th}$ feature at the $j*T_s$ instant in time, where $T_s$ is the sample time.

If $f_i$ is the frequency of the $i^{th}$ feature, then the total power contained in the vibration signal at time index 'j' is calculated as, $$P_j = \sum_{i=1}^{n^i} \left[ s_{ij} \times \frac{(f_i)^2}{10^6} \right], \; j = 1, \ldots, n_j.$$

Figure 4:
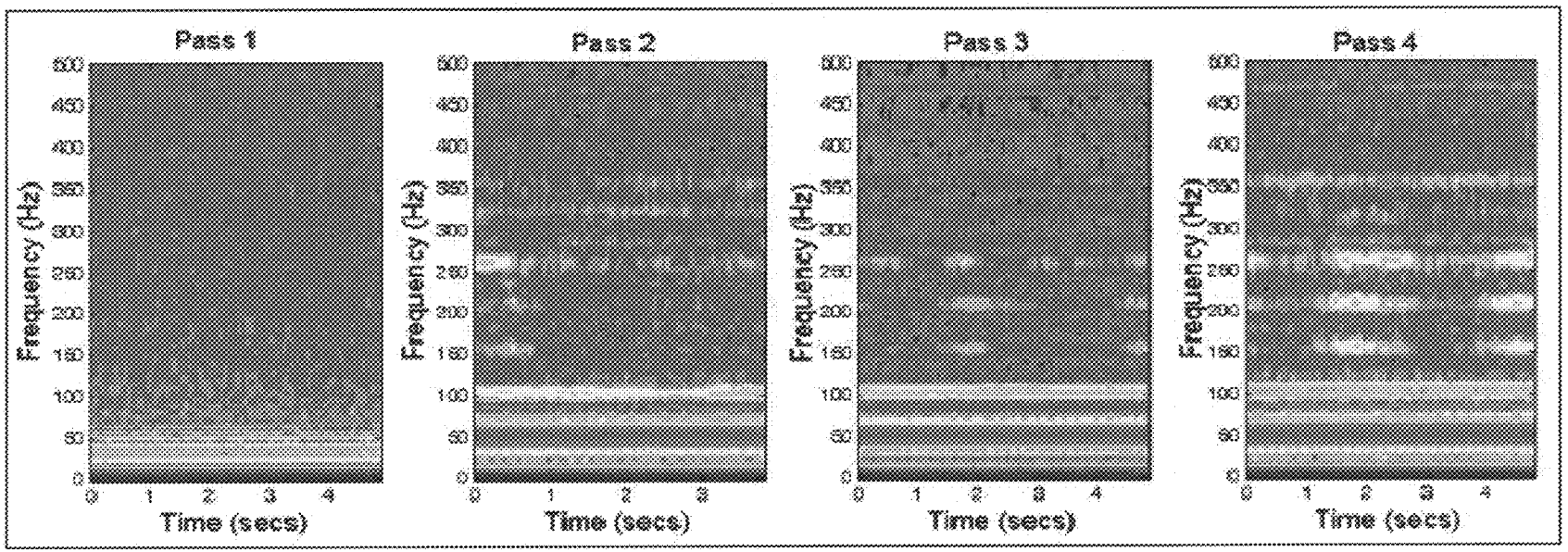
FIG. 4 is a spectrogram, and shows a five-second data set for passes made by the roller.

For a set of 'm' consecutive time indices, the power feature of that set is calculated by $$P_r = \frac{1}{m} \sum_{j=r}^{r+m-1} P_j,$$

r is the index of power feature of set of m consecutive time indices, $r=1, \ldots, n_r$; $n_r=n_j-m+1$. An example showing the power contained in the vibration signal over successive roller passes over a stretch of pavement during its compaction is shown in FIG. 4. In the figure, the power index is set to three (3), that is the power content over three successive time instants is averaged to determine the average power content at a given instant. The three successive time instants may be, for example, three consecutive intervals of 0.125 seconds since as explained earlier, features may be extracted every 0.125 seconds.

Figure 5:
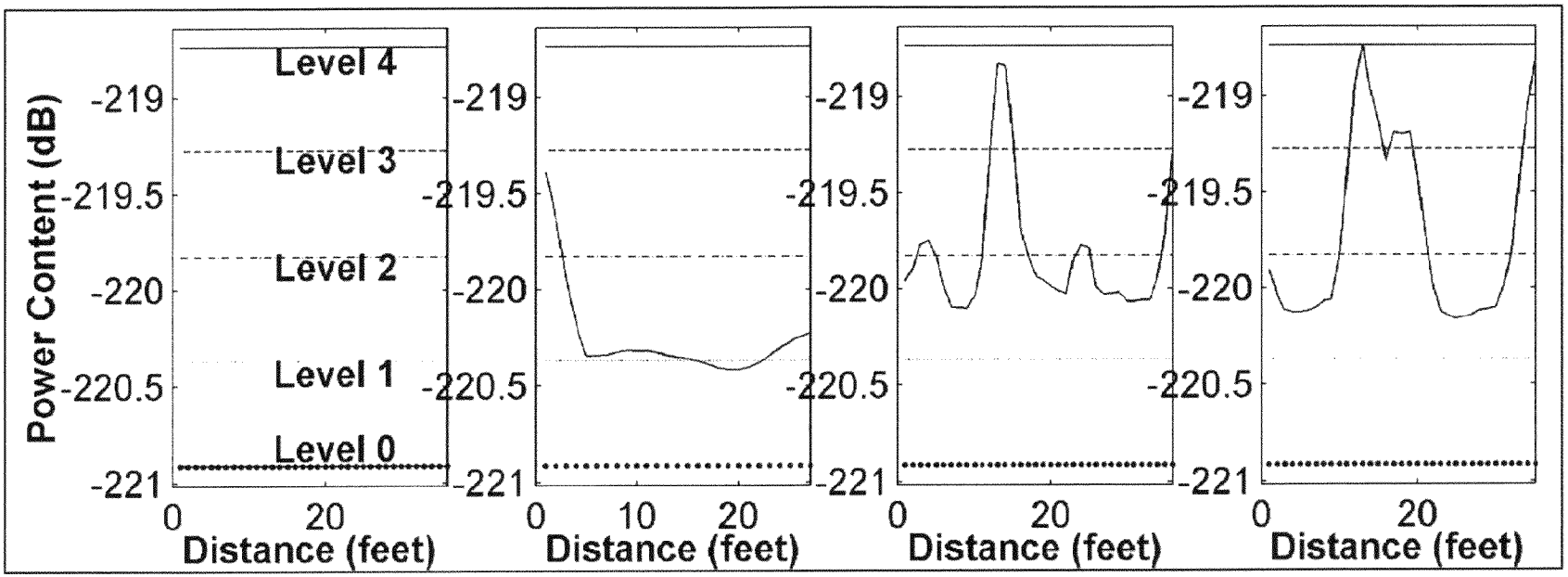
FIG. 5 shows the power content of the signals represented in FIG. 4.

Once the power content of the responsive vibratory signals of roller 10 are calculated, a spectrogram, like the one shown in FIG. 5, can be used to identify the locations on portion 40 where the maximum and minimum power occurred, and the locations of equally spaced power levels, for example, three equally spaced power levels therebetween. Generally, five identified power levels are designated as corresponding to minimum compaction level 0, equally spaced compaction levels 1, 2 and 3, and maximum compaction level 4.

The features extracted by feature extractor 34, namely the frequencies and the amplitudes of the frequencies are used as inputs to neural network 36. Neural network 36 will classify the features and identify the features as corresponding to one of the compaction levels 0, 1, 2, 3 or 4. As explained previously, each time a feature extraction occurs, 200 features representative of the responsive vibration signal of the roller at that time, namely, the 200 frequencies and the normalized power (squares of the amplitudes) of those frequencies are provided as inputs to the neural network. Only 200 features are utilized and those features in the lower range (i.e., 0-100 Hz) are ignored. The network will be trained so that the output of the neural network is one of compaction levels 0, 1, 2, 3, 4. The neural network will be trained to recognize the extracted features as being the same, or most similar to the features that correspond to one of the identified power levels, and will be classified accordingly. Thus, if the extracted features are most similar to the features that correspond to the minimum power level, the output of the neural network will be the indicator 0, for the minimum compaction level. If the extracted features are most similar to those contained in the maximum power signal, the output of the neural network will be the number 4, which indicates that the maximum compaction has been reached. The same process will occur when the extracted features are features that are most similar to those at one of the equally spaced power levels, in which case the output of the neural network will be one of the numbers 1, 2 or 3. During the training process, the interconnection weights of the neural network are modified to minimize the error between the output of the neural network and the level of compaction corresponding to each data set.

Prior to rolling portion 40, a plurality of initial inputs are entered into the compaction analyzer module 38. The initial inputs include the mix parameters of the roadway materials which may include, for example, type of construction (full depth, overlay, etc.), mix type, pavement lift, and lift thickness. Other initial inputs include the maximum estimated density, $l_{max}$, and a minimum estimated density, $l_d$ which may be the estimated lay-down density. $l_{max}$ will be the target density as described herein. Additional initial inputs to be entered into analyzer module 38 include an initial offset ($off_{in}$) which is an estimated, or assumed offset, or difference between the assumed lay-down density $l_d$ and the actual lay-down density, and an initial slope $k_{in}$. The slope constant is simply the slope of a line running through $l_{max}$ and $l_d$, and the compaction levels. Thus, in the described embodiment, $k_{in}$ is equal to 1/n−1 ($l_{max}$−$l_d$) in this case 1/5−1 or 0.25 ($l_{max}$−$l_d$) where n is the number of compaction levels, starting with compaction level 0.

When roller 10 moves along portion 40 of roadway section 42, the GPS sensor 32 will trigger accelerometer 24 to begin collecting vibration data when location A is reached. The coordinates at the beginning A and end E of the portion 40 may be, for example, at the center of the width of the roadway portion 40. The coordinates will be utilized to start and stop the collection of responsive vibration signals of roller 10 as roller 10 passes over portion 40. The additional locations B, C and D may be, for example, at five, fifteen and twenty-five feet and are marked as well, at the center of the width of the portion 40 of the roadway section. When the features extracted by feature extractor 34 are classified by neural network 36, the compaction level will be an input to the analyzer module 38, which will utilize the initially entered input parameters and will generate a display of an estimated density. The estimated density $d_{est}$ will be calculated with the equation $d_{est}=l_d+k_{in}*C_l+off_{in}$ where $C_l$ is the level of compaction. For example, assuming a laydown density $l_d$ of 88%, and a maximum estimated density of 96%, with three equally spaced levels therebetween, an output of the neural network of 2 and the offset assumed to be 0, $d_{est}$=88+0.25 (96−88)(2)+0=92. Analyzer module 38 will thus convert the compaction level into an estimated density percentage, 92 in the example, as an output on display 44.

It will be understood that because of the speed of the roller 10, and the rapidity of the pace at which samples are taken, the display, in the absence of any filtering, would likely rapidly alternate between estimated densities so that the display may be unreadable. Low pass filters can be used to smooth out the signal, and the visible output on the IACA display as a result of the filtering will likely not be a whole number. Once no change in compaction is occurring, roller 10 ceases making passes, or moving along the portion 40. Core samples are removed at locations A, B, C, D and E which were previously marked on the center of portion 40 of roadway section 42. The actual densities of the cores are measured, and are compared to the estimated densities (i.e., $d_{est}$) at each of the identified locations. The density of the cores may be measured in the laboratory according to AASHTO T-166 method. The locations and estimated level of compaction at each of the locations is determined through GPS measurements and the output of the neural network 36 as described. The location of the estimated densities is available from the display, since the GPS unit 32 will provide the location at which the estimated densities occur. The slope and offset are then adjusted, or modified to minimize the square of the error between the estimated and measured densities. The adjusted or modified slope and offset are represented by $k_{adj}$ and $off_{adj}$.

Once both the measured and estimated densities are known, the adjusted offset, is calculated as the mean error between the estimated and the measured densities so that $$off_{adj} = \frac{1}{n}\sum_{i=1}^{n}(d^i_{meas} - d^i_{est})$$

where n is the number of locations at which a measured density is taken, in this case five locations. Thus, $off_{adj}$ is the average error. The notations used in the derivation and steps used in calculating the adjusted slope and offset are as follows.

k—slope off—offset $l_d$—lay-down density $C_l$ or $_{lnn}$—output of the neural network (compaction level)

$d_{est}$—estimated density of the neural network, and $d_{meas}$ or $d_{meas}$—measured density.

The calibration scheme using the measured density is as follows. The new offset, $off_{adj}$, is calculated as set forth above.

Assume n density measurements, $d^i_{meas}$, i=1, . . . , n, the corresponding estimated densities are given by $d^i_{est}$=1, . . . , n, where $d^i_{est}=l_d+k_{in}*C_l^i+off_{in}$, as described above.

The error between the raw estimates and the measured densities are calculated as follows.

$$e_i = d^i_{est} - d^i_{meas} = 1_d + k_{in} \times C^i_1 + off_{in} - d^i_{meas}$$

$$\sum_{i=1}^{n} e_i^2 = \sum_{i=1}^{n}(1_d + k \times C^i_1 + off_{in} - d^i_{meas})^2 =$$

$$\sum_{i=1}^{n}[(1_d + off_{in} - d^i_{meas}) + k \times C^i_1]^2 = \sum_{i=1}^{n}(1_d + off_{in} - d^i_{meas})^2 +$$

$$\sum_{i=1}^{n}[(1_d + off_{in} - d^i_{meas}) \times (k \times C^i_1)] + \sum_{i=1}^{n}(k \times C^i_1)$$

Minimizing the mean square error (MSE), one obtains the desired adjusted stop slope $k_{adj}$.

$$\frac{d}{dk}\sum_{i=1}^{n} e_i^2 = 0$$

$$\Rightarrow 2\sum_{i=1}^{n}[(1_d + off_{in} - d^i_M) + C^i_1] + 2k\sum_{i=1}^{n}(C^i_1)^2 = 0$$

$$\Rightarrow k\sum_{i1}^{n}(C^i_1)^2 = \sum_{i=1}^{n}[(d^i_{meas} - 1_d - off_{in}) \times C^i_1)]$$

$$k_{adj} = \frac{\sum_{i=1}^{n}[(d^i_{meas} - 1_d - off_{in}) \times C^i_1]}{\sum_{i=1}^{n}(C^i_1)^2}$$

Once the adjusted offset and slope are determined, the initial input parameters are adjusted to utilize $off_{adj}$ and $k_{adj}$ in the density calculation in the analyzer module. Analyzer module 38 will use the equation $d^i_{adj}=l_d+k_{adj}\times C_l^i+off_{adj}$ to arrive at the adjusted density readout. The adjusted density is a more reliable indicator of actual density of roadway portion 40 than is $d_{est}$. Once the selected initial input parameters have been adjusted, the roller 10 can roll the remainder of roadway section 42, and IACA display 44 will generate an adjusted density that can be viewed and relied upon by the operator. The roller 10 can make passes on roadway section 42 until the IACA display indicates a predetermined desired final density, at which point roller 10 can be moved to another roadway section. If the additional roadway section has the same mix parameters as roadway section 42, there is no need for recalibration. The adjusted density is determined using the initial input parameters, except for the selected adjusted input parameters, namely, $k_{adj}$ and $off_{adj}$, along with the compaction level delivered to the analyzer module from the neural network.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A method of compacting a roadway section with a roller having a compaction analyzer operably associated therewith comprising:

entering initial input parameters into the compaction analyzer;

making a plurality of passes with the roller over a portion of the roadway section;

applying a vibratory energy to the portion of the roadway section with the roller as it moves over the portion of the roadway section;

repeatedly gathering responsive vibration signals of the roller as it moves over the portion of the roadway section;

generating, with the compaction analyzer, estimated density signals representative of estimated densities based upon the responsive vibration signals of the roller and the initial input parameters entered into the compaction analyzer;

measuring the density of the roadway section at a plurality of locations on the portion of the roadway section;

comparing the measured densities with the estimated densities at the plurality of locations to determine the difference between the measured and the estimated densities;

adjusting selected ones of the initial input parameters to the analyzer based on the difference between the measured densities and the estimated densities so that an adjusted density output signal generated by the compaction analyzer will more closely approximate an actual density of the roadway section than does the estimated density signal; and rolling the remainder of the roadway section until the compaction analyzer with the adjusted input parameters generates a desired adjusted output density signal.

2. The method of claim 1, wherein the initial input parameters include mix characteristics of roadway material, an estimated minimum density ($l_d$) and an estimated maximum density ($l_{max}$).

3. The method of claim 1, wherein ($l_d$) is a specified laydown density and $l_{max}$ is a target density achieved in a mix specification for the roadway material ($l_{max}$).

4. The method of claim 3, further comprising:

identifying the responsive vibration signals with the highest power, the lowest power, and equally spaced power levels therebetween; and designating specified minimum, maximum and equally spaced compaction levels as corresponding to the responsive vibration signals with the highest, lowest, and equally spaced powers;

delivering the compaction levels to an analyzer module of the compaction analyzer; and generating the estimated density ($d_{est}$) of the portion of the roadway section in real time with the formula $d_{est}=l_d+k_{in}(C_l)+off_{in}$, where $k_{in}$ is an initial slope parameter that is an initial input parameter, $off_{in}$ is an estimated offset from the minimum estimated density and is also an initial offset parameter, and $C_l$ is the compaction level delivered to the analyzer module.

5. The method of claim 4, wherein the adjusting step comprises adjusting the initial slope and offset parameters, so that the compaction analyzer will generate an adjusted density ($d_{adj}$) with the formula $d_{adj}=l_d+k_{adj}(C_l)+offset_{adj}$, where $k_{adj}$ and $off_{adj}$ are the adjusted slope and offset parameters respectively.

6. The method of claim 4 wherein the power of a given responsive vibration signal is calculated using the equation $$p=\sum_{i=1}^{n}\left[S_i\times\frac{(f_i)^2}{10^6}\right]$$

where $f_i$ represents a plurality of frequencies contained in the given responsive vibration signal and $S_i$ is the square of the amplitude of the frequencies.

7. The method of claim 6 wherein the initial slope parameter $k_{in}$ is represented by the equation $k_{in}=1/n-1\ (l_{max}-l_d)$ where n is the total number of compaction levels beginning with compaction level 0, and wherein the estimated initial offset is zero.

8. The method of claim 7, wherein the adjusting step comprises adjusting the initial slope and offset parameters, and generating an adjusted density ($d_{adj}$) with the formula $d_{adj}=l_d+k_{adj}(C_l)+offset_{adj}$, where $k_{adj}$ and $off_{adj}$ are the adjusted slope and offset parameters respectively.

9. The method of claim 8, wherein the adjusted offset is calculated using the equation $$off_{adj}=\frac{1}{n}\sum_{i=1}^{n}(d_{meas}^{i}-d_{est}^{i})$$

where n is the number of the plurality of locations at which density is measured, $d_{est}$ is the estimated density at the plurality of locations, $d_{meas}$ is the measured density at the plurality of locations and the adjusted slope is calculated using the equation $$k_{adj}=\sum_{i=1}^{n}\frac{[d_{meas}^{i}-1_d-off_{adj})\times C_1^{i}]}{\sum_{i=1}^{n}=(C_1^{i})^2}.$$

10. The method of claim 4 further comprising extracting selected features from the responsive vibration signals, including a plurality of frequencies, ($f_i$) contained in each signal, and the amplitudes ($a_i$) at each of the frequencies.

11. The method of claim 10, wherein the power of a responsive vibration signal is calculated using the formula $$p = \sum_{i=1}^{n} \left[ S_i \times \frac{(f_i)^2}{10^6} \right],$$

where n is the number of frequencies considered and is at least a portion of the frequencies extracted from the signal, $f_i$ are the frequencies measured in Hz and $S_i$ are the squares of the amplitudes of the frequencies.

12. The method of claim 11 further comprising classifying the extracted features into a plurality of classes, each class representing one of the specified compaction levels.

13. The method of claim 12, the classifying step comprising determining whether the extracted features most closely resemble the features extracted from the responsive vibratory signal with the highest, lowest, or one of the equally spaced powers, and associating the extracted features with the compaction level corresponding to that power level.

14. The method of claim 12 wherein the initial slope $k_{in}$ is defined by the equation $1/(n-1)(l_{max}-l_d)$ where n is the number of specified compaction levels beginning with level 0 and the initial offset is an estimated difference between an actual minimum density and the estimated minimum density, the initial offset being assumed to be zero.

15. The method of claim 14, the adjusting step comprising adjusting the initial offset and slope parameters based upon the differences between the estimated densities generated at the measured locations and the actual measured densities at the measured locations.

16. The method of claim 15, where the adjusted offset is calculated using the equation $$off_{adj} = \frac{1}{n} \sum_{i=1}^{n} (d_{meas}^{i} - d_{est}^{i})$$

where $d_{est}$ is the estimated density at the plurality of locations and $d_{meas}$ is the measured density at the plurality of locations and the adjusted slope is calculated using the equation $$k_{adj} = \sum_{i=1}^{n} \frac{[d_{meas}^{i} - 1_d - off_{in}) \times C_1]}{\sum_{i=1}^{n} = (C_1)^2}.$$

17. The method of claim 16, the adjusted density output signal being generated with the equation $d_{adj}=l_d+k_{adj}\ (C_l)+\text{offset}_{adj}$, where $k_{adj}$ and $off_{adj}$ are the adjusted slope and offset parameters respectively.

18. Method of calibrating a compaction analyzer operably associated with a roller for rolling an asphalt roadway section comprising:

entering initial input parameters into the compaction analyzer;

making a plurality of passes with the roller over a portion of the roadway section;

applying a vibratory energy to the portion of the roadway section as the roller makes the plurality of passes;

collecting the vibratory response signals of the roller on the portion of the roadway section to the applied vibratory energy;

generating estimated density signals with the compaction analyzer based upon the vibratory response signals;

measuring the density of the portion of the roadway section at a plurality of locations thereon;

calculating the difference between the measured densities and the estimated densities generated by the compaction analyzer at the plurality of locations; and adjusting selected ones of the initial input parameters in the compaction analyzer based on the calculated difference;

generating adjusted density signals with the compaction analyzer based upon the vibratory response signals of the roller using the adjusted input parameters that will more closely approximate the actual density of the roadway section as it is rolled by the roller than do the estimated density signals.

19. The method of claim 18 further comprising:

calculating the power in the collected vibratory response signals;

designating a maximum calculated power level as corresponding to a maximum compaction level and a minimum calculated power level as corresponding to a minimum compaction level;

designating a plurality of calculated power levels equally spaced between the minimum and maximum calculated power levels as corresponding to equally spaced compaction levels between the maximum and minimum compaction levels;

delivering to an analyzer module in the compaction analyzer the compaction level of the portion of the roadway section as the roller moves over the portion of the roadway section;

the generating estimated density signals step comprising determining with the compaction analyzer estimated densities of the portion of the roadway in real time based upon the compaction levels delivered thereto and the initial input parameters; and displaying estimated density signals representative of the estimated densities as the roller moves over the portion of the roadway section.

20. The method of claim 19, wherein power in each collected vibratory response signal is calculated as:

$$p = \sum_{i=1}^{n} \left[ S_i \times \frac{(f_i)^2}{10^6} \right]$$

where p=power, $f_i$ represents a plurality of the frequencies contained in the collected signal, and $S_i$ is the square of the amplitudes at the frequencies.

21. The method of claim 19, wherein a minimum estimated density ($l_d$) and a maximum estimated density ($l_{max}$) comprise initial input parameters.

22. The method of claim 21 wherein the plurality of input parameters comprise, in addition to the minimum estimated density and the maximum estimated density, an initial slope parameter ($k_{in}$) and an initial offset parameter ($off_{in}$), the adjusting step comprising adjusting the slope parameter to an adjusted slope ($k_{adj}$) and the offset parameter to an adjusted offset ($off_{adj}$).

23. The method of claim 22 comprising:

determining the initial slope with the equation $k_{in}=1/n-1\ (l_{max}-l_d)$, where n is equal to the total number of compaction levels starting with compaction level 0 as the minimum compaction level, wherein the initial offset is an assumed offset from the minimum estimated density.

24. The method of claim 23 wherein the estimated densities ($d_{est}$) are generated by the analyzer using the equation $d_{est}=l_d+k_{in}\times C_l+off_{in}$ where $C_l$ is the numeric indicator for the compaction level.

25. The method of claim 24 comprising:

calculating the adjusted offset $off_{adj}$ with the equation $$off_{adj} = \frac{1}{n}\sum_{i=1}^{n}(d_{meas}^{i} - d_{est}^{i})$$

calculating the adjusted slope $k_{adj}$ with the equation $$k_{adj} = \sum_{i=1}^{n}\frac{[d_{meas}^{i} - 1_d - off_{in}) \times C_1]}{\sum_{i=1}^{n} = (C_1^{i})^2}$$

the adjusting step comprising adjusting the slope and offset parameters, the adjusted density signal being generated by the analyzer module with the equation $d_{adj}=l_d+k_{adj}\times C_l+off_{adj}$.

26. The method of claim 23 further comprising extracting features from the responsive vibratory signals, the features comprising a plurality of the frequencies contained in the vibratory response signal and the amplitudes of the frequencies, wherein the power in each signal is calculated using the equation $$p = \sum_{i=1}^{n}\left[S_i \times \frac{(f_i)^2}{10^6}\right]$$

where $f_i$ is a plurality of frequencies of the signal and $S_i$ is the square of the amplitudes of the frequencies.

27. The method of claim 26, further comprising classifying the extracted features into a plurality of classes, wherein each class represents one of the specified compaction levels, the delivering step comprising delivering to the analyzer module the compaction level representative of the class in which the extracted features are placed.

28. The method of claim 27, the classifying step comprising determining whether the extracted features most closely resemble the features extracted from the responsive vibratory signal with the highest, lowest, or one of the equally spaced power levels, and placing the extracted features in the class that is representative of the compaction level corresponding to that power level.

29. Method of calibrating a compaction analyzer mounted to a roller for rolling a roadway section comprising:

entering initial input parameters into the compaction analyzer;

making a plurality of passes over a portion of the roadway section;

applying a vibratory energy to the portion of the roadway section as the plurality of passes are made;

gathering responsive vibratory signals of the roller generated in response to the applied vibratory energy;

designating selected responsive vibratory signals as corresponding to specified compaction levels;

delivering the compaction levels of the portion of the roadway section representative of the responsive vibratory signals in real time to an analyzer module in the compaction analyzer as the roller moves along the portion of the roadway section;

generating an estimated density in real time with the compaction analyzer based on the delivered compaction level and the initial input parameters as the roller rolls along the portion of the roadway;

taking actual density measurements of the portion of the roadway section at a plurality of locations on the portion of the roadway section to determine measured densities at the plurality of locations;

comparing the estimated densities generated by the compaction analyzer at the plurality of locations with the actual measured densities at the plurality of locations;

adjusting selected ones of the initial input parameters based upon the differences between the estimated densities and the measured densities; and generating an adjusted density of the roadway section in real time that will more closely approximate the actual density than did the estimated density using the delivered compaction levels and the adjusted input parameters.

30. The method of claim 29 comprising:

calculating the power in the responsive vibratory signals;

identifying the responsive vibratory signals with the highest power, the lowest power, and equally spaced powers therebetween;

the designating step comprising designating the lowest power, highest power and equally spaced powers as corresponding to a lowest compaction level, a highest compaction level and equally spaced compaction levels therebetween.

31. The method of claim 30, wherein the power is calculated using the equation $$p = \sum_{i=1}^{n}\left[S_i \times \frac{(f_i)^2}{10^6}\right]$$

where $f_i$ represents a plurality of frequencies contained in the given responsive vibration signal and $S_i$ is the square of the amplitude of the frequencies.

32. The method of claim 30, wherein the initial input parameters comprise the mix parameters of a roadway material being rolled upon by the roller, a minimum estimated density ($l_d$) of the material, a maximum estimated density ($l_{max}$) of the material, an initial slope parameter $k_{in}$ and an initial offset parameter $off_{in}$.

33. The method of claim 32, wherein the slope parameter comprises an initial slope defined by the equation $k=1/n-1(l_{max}-l_d)$ where n is equal to the total number of compaction levels beginning with a compaction level of 0, and the offset parameter comprises an estimated difference between $l_d$ and an actual minimum density of the portion of the roadway section.

34. The method of claim 32, wherein $l_{max}$ is a target density and $l_d$ is an estimated lay-down density.

35. The method of claim 33 wherein the estimated densities are generated with the analyzer using the equation $d_{est}=l_d+k_{in}(C_l)+off_{in}$ where $C_l$ represents the compaction level and the initial offset is assumed to be zero.

36. The method of claim 35, the adjusting step comprising adjusting the initial slope and the initial offset to an adjusted slope $k_{adj}$ and an adjusted offset ($off_{adj}$) based on the difference between the measured densities and estimated densities at the plurality of locations.

37. The method of claim 36, wherein the adjusted offset is calculated using the equation $$off_{adj} = \frac{1}{n}\sum_{i=1}^{n}(d^i_{meas} - d^i_{est})$$

where $d^i_{est}$ is the estimated density at the plurality of locations and $d_{meas}$ is the measured density at the plurality of locations and the adjusted slope is calculated using the equation $$k_{adj} = \sum_{i=1}^{n}\frac{[d_{meas} - 1_d - off_{in}) \times C_1]}{\sum_{i=1}^{n} = (C_1)^2}.$$

38. The method of claim 30, further comprising extracting features from the responsive vibratory signals, the features comprising a plurality of frequencies contained in the responsive vibratory signals, and the corresponding amplitudes of each frequency.

39. The method of claim 38 wherein the power in a responsive vibration signal at a given time is calculated using the equation $$\sum_{i=1}^{n}\left[S_i \times \frac{(f_i)^2}{10^6}\right]$$

where $f_i$ is a plurality of frequencies contained in the signal and $S_i$ is the square of the amplitudes of the plurality of frequencies.

40. The method of claim 39 comprising designating a minimum compaction level as 0, the maximum compaction level as n, and the equally spaced compaction levels with equally spaced numbers 1 to n and associating the minimum compaction level, the maximum compaction level, and the equally spaced compaction levels as corresponding to the responsive vibratory signals with the lowest power, highest power, and equally spaced powers therebetween.

41. The method of claim 39, wherein n=4, so that the number of compaction levels is 5, and are identified as compaction levels 0, 1, 2, 3 and 4.

42. The method of claim 41, further comprising classifying the extracted features into a plurality of classes, wherein each class represents one of the specified compaction levels.

43. The method of claim 42, the classifying step comprising determining whether the extracted features most closely resemble the features extracted from the responsive vibratory signal with the highest, lowest, or one of the equally spaced power levels, and associating the extracted features with the class that is representative of the compaction level corresponding to the power level, the delivering step comprising delivering the compaction level representative of the class to the analyzer module.

44. The method of claim 43, the initial input parameters comprising an initial slope parameter $k_{in}$, an offset parameter $off_{in}$, a minimum estimated density ($1_d$) and a maximum estimated density ($1_{max}$), the generating an estimated density step comprising calculating estimated densities using the equation $d_{est}=1_d+k_{in}(C_l)+off_{in}$.

45. The method of claim 44 wherein the initial slope parameter $k_{in}$ is defined by the equation $k_{in}=1/n-1(1_d-1_{max})$ where n is equal to the total number of compaction levels, and the $off_{in}$ comprises the difference between the minimum estimated density and an actual minimum density.

46. The method of claim 45, wherein the modified offset is calculated using the equation $$off_{adj} = \frac{1}{n}\sum_{i=1}^{n}(d^i_{meas} - d^i_{est})$$

where $d^i_{est}$ is the estimated density at the plurality of locations and $d_{meas}$ is the measured density at the plurality of locations and the adjusted slope is calculated using the equation $$k_{adj} = \sum_{i=1}^{n}\frac{[(d^i_{meas} - 1_d - off_{in}) \times C^i_1]}{\sum_{i=1}^{n} = (C^i_1)^2}.$$

47. The method of claim 46, comprising calculating the density of the remainder roadway section with the equation $$d_{adj}=l_d+k_{adj}(C_l)+off_{adj}.$$

48. The method of claim 47 comprising rolling the remainder of the roadway section until the analyzer with the adjusted input parameters generates a desired adjusted density.

* * * * *

UNITED STATES PATENT AND TRADEMARK OFFICE

CERTIFICATE OF CORRECTION

PATENT NO. : 8,190,338 B2
APPLICATION NO. : 12/583838
DATED : May 29, 2012
INVENTOR(S) : Sesh Commuri It is certified that error appears in the above-identified patent and that said Letters Patent is hereby corrected as shown below:

Column 10, lines 27-30, delete:

$$\sum_{i=1}^{n} [(l_d + off_{in} - d^i_{meas}) + k \times C_l^{\,i}]^2 = \sum_{i=1}^{n} (l_d + off_{in} - d^i_{meas})^2 +$$

$$\sum_{i=1}^{n} [(l_d + off_{in} - d^i_{meas}) \times (k \times C_l^{\,i})] + \sum_{i=1}^{n} (k \times C_l^{\,i})$$

"

and insert:

$$\sum_{i=1}^{n} [(l_d + off_{in} - d^i_{meas}) + k \times C_l^{\,i}]^2 = \sum_{i=1}^{n} (l_d + off_{in} - d^i_{meas})^2 + 2$$

$$\sum_{i=1}^{n} [(l_d + off_{in} - d^i_{meas}) \times (k \times C_l^{\,i})] + \sum_{i=1}^{n} (k \times C_l^{\,i})^2$$

-- therefor;

Signed and Sealed this
Fourteenth Day of August, 2012

David J. Kappos

David J. Kappos
*Director of the United States Patent and Trademark Office*

Column 10, line 40, delete:

$$\text{“}\ \Rightarrow 2\sum_{i=1}^{n}\ [(l_d + off_{in} - d^i_M) + C_l{}^i]\ + 2k\sum_{i=1}^{n}\ (C_l{}^i)^2 = 0\ \text{”}$$

and insert:

$$\text{--}\ \Rightarrow 2\sum_{i=1}^{n}\ [(l_d + off - d^i_M)\ \text{x}\ C_l{}^i] + 2k\sum_{i=1}^{n}\ (C_l{}^i)^2 = 0\ \text{--}$$

therefor.